US010023998B2

(12) United States Patent
Rosset

(10) Patent No.: US 10,023,998 B2
(45) Date of Patent: Jul. 17, 2018

(54) CRUMPLE-RESISTANT SECURITY SHEET, A METHOD OF MANUFACTURING SUCH A SHEET, AND A SECURITY DOCUMENT INCLUDING SUCH A SHEET

(75) Inventor: Henri Rosset, Le Pin (FR)

(73) Assignee: ARIOWIGGINS SECURITY, Paris (FR)

( * ) Notice: Subject to any disclaimer, the term of this patent is extended or adjusted under 35 U.S.C. 154(b) by 671 days.

(21) Appl. No.: 12/599,219

(22) PCT Filed: May 28, 2008

(86) PCT No.: PCT/FR2008/050924

§ 371 (c)(1),
(2), (4) Date: Nov. 25, 2009

(87) PCT Pub. No.: WO2008/152299

PCT Pub. Date: Dec. 18, 2008

(65) Prior Publication Data

US 2010/0078930 A1 Apr. 1, 2010

(30) Foreign Application Priority Data

May 31, 2007 (FR) ..... 07 55382

(51) Int. Cl.

| | |
|---|---|
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |
| ***B44F 11/00*** | (2006.01) |
| ***D21F 11/00*** | (2006.01) |
| ***B42D 1/00*** | (2006.01) |
| ***B42D 19/00*** | (2006.01) |
| ***B42D 15/00*** | (2006.01) |
| ***D21H 21/40*** | (2006.01) |
| ***D21H 17/42*** | (2006.01) |
| ***D21H 17/43*** | (2006.01) |
| ***D21H 17/44*** | (2006.01) |
| ***D21H 21/18*** | (2006.01) |
| ***D21H 21/20*** | (2006.01) |

(52) U.S. Cl.
CPC ..... *D21H 21/40* (2013.01); *D21H 17/42* (2013.01); *D21H 17/43* (2013.01); *D21H 17/44* (2013.01); *D21H 21/18* (2013.01); *D21H 21/20* (2013.01)

(58) Field of Classification Search
CPC . B42D 1/00; B42D 3/04; B42D 19/00; B42D 15/00; D21H 17/33–17/35; D21H 17/41–17/45; D21H 17/53–17/56; D21H 19/00; D21H 21/06; D21H 21/10; D21H 21/18; D21H 21/40; D21H 13/24; D21H 13/26; D21H 21/20
USPC .... 281/2, 3.1, 5; 283/61, 62, 67, 70, 95, 96, 283/107; 162/140, 158, 164.1, 164.2
See application file for complete search history.

(56) References Cited

U.S. PATENT DOCUMENTS

| | | | | |
|---|---|---|---|---|
| 2,721,140 | A | 10/1955 | Weisgerber | |
| 2,931,749 | A | 4/1960 | Kine et al. | |
| 3,483,025 | A | 12/1969 | Isaacs | |
| 3,776,812 | A * | 12/1973 | Jongetjes | C08C 1/14 162/168.1 |
| 3,792,128 | A | 2/1974 | Uffner et al. | |
| 4,112,192 | A | 9/1978 | Vreeland | |
| 4,121,966 | A | 10/1978 | Amano et al. | |
| 4,189,345 | A * | 2/1980 | Foster | C08F 8/00 162/168.1 |
| 4,247,318 | A | 1/1981 | Lee et al. | |
| 4,400,440 | A | 8/1983 | Shaw | |
| 4,460,348 | A | 7/1984 | Iioka et al. | |
| 5,342,875 | A | 8/1994 | Noda | |
| 5,405,500 | A | 4/1995 | Knight | |
| 5,447,335 | A * | 9/1995 | Haslop | G03H 1/0011 283/91 |
| 5,565,062 | A * | 10/1996 | Nass | D04H 1/641 162/168.1 |
| 5,660,919 | A * | 8/1997 | Vallee | B41M 1/10 101/150 |
| 5,977,211 | A | 11/1999 | Koyama | |

(Continued)

FOREIGN PATENT DOCUMENTS

| | | | |
|---|---|---|---|
| CZ | 186814 | B1 | 2/1981 |
| DE | 102005052672 | A1 | 5/2007 |

(Continued)

OTHER PUBLICATIONS

International Search Report dated Jan. 22, 2009 in the corresponding International Application No. PCT/FR2008/050924.

(Continued)

*Primary Examiner* — Justin V Lewis

(74) *Attorney, Agent, or Firm* — Oliff PLC

(57) ABSTRACT

The present invention relates to a crumple-resistant security sheet comprising fibers; an anionic polymer in a proportion lying in the range 5% to 45% by dry weight relative to the total dry weight of the fibers, and presenting a glass transition temperature greater than 40° C.; and a main cationic flocculation agent in a quantity lying in the range 1% to 5% by dry weight relative to the total dry weight of the fibers.

21 Claims, No Drawings

(56) References Cited

U.S. PATENT DOCUMENTS

| | | | | |
|---|---|---|---|---|
| 6,013,757 | A * | 1/2000 | Corley | C08G 59/54 428/413 |
| 8,851,385 | B2 | 10/2014 | Vogt et al. | |
| 2003/0105190 | A1 | 6/2003 | Diehl et al. | |
| 2003/0234089 | A1 | 12/2003 | Ryan et al. | |
| 2004/0023008 | A1 | 2/2004 | Rosset | |
| 2004/0197496 | A1* | 10/2004 | Song | B41M 5/52 428/32.25 |
| 2006/0037727 | A1* | 2/2006 | Hagiopol | C08F 8/28 162/168.3 |
| 2006/0141882 | A1* | 6/2006 | Quincy et al. | 442/164 |
| 2006/0143989 | A1 | 7/2006 | Lindquist et al. | |
| 2006/0249268 | A1* | 11/2006 | Ryan et al. | 162/158 |
| 2007/0065187 | A1 | 3/2007 | Kodera et al. | |
| 2007/0090196 | A1* | 4/2007 | Vast et al. | 235/494 |
| 2008/0020200 | A1* | 1/2008 | Stokes et al. | 428/332 |
| 2010/0078930 | A1 | 4/2010 | Rosset | |
| 2011/0089677 | A1 | 4/2011 | Rosset | |

FOREIGN PATENT DOCUMENTS

| | | | |
|---|---|---|---|
| EP | 0 024 602 | B1 | 10/1983 |
| EP | 0 717 146 | A2 | 6/1996 |
| EP | 1 241 225 | A2 | 9/2002 |
| EP | 1 338 430 | A1 | 8/2003 |
| EP | 0 695 830 | B1 | 7/2004 |
| EP | 1 469 125 | A1 | 10/2004 |
| GB | 824286 | A | 11/1959 |
| WO | WO 91/12372 | | 8/1991 |
| WO | 99/33901 | A1 | 7/1999 |
| WO | 00/039391 | A1 | 7/2000 |
| WO | WO 02/20902 | A1 | 3/2002 |
| WO | WO 02/46529 | A1 | 6/2002 |
| WO | 03/052197 | A2 | 6/2003 |
| WO | 2006/048280 | A1 | 5/2006 |
| WO | 2008/152299 | A2 | 12/2008 |
| WO | 2009/150117 | A1 | 12/2009 |

OTHER PUBLICATIONS

Mar. 16, 2012 Russian Office Action issued in Russian Application No. 200914316/12(062057) with English-language translation.

Jun. 17, 2015 Notice of Opponent issued in European Patent No. 2 148 954.

Jul. 23, 2014 Notice of Opposition issued in European Patent No. 2 148 954.

Hercules Incorporated, Product Data KYMENE 557 H, published Aug. 25, 1987, 3 pages.

Battista, "Synthetic Fibers in Papermaking," Polymer Engineering and Technology, pp. 56-96, Feb. 1964.

Chan, "Wet-Strength Resins and Their Application," Tappi Press, 1994.

Nakamura et al., "Heat Capacities of Carboxymethylcellulose-Nonfreezng Water Systems at Around Glass Transition Temperature," Kobunshi Ronbunshu, vol. 53, No. 12, pp. 860-865, Dec. 1996.

Das Papierbuch, Handbuch der Papierherstellung, ECA Pulp & Paper b.v, 2nd Edition 2006.

U.S. Appl. No. 14/646,577, filed May 21, 2015 in the name of Pierre Sarrazin.

May 4, 2016 Office Action issued in U.S. Appl. No. 14/646,577.

Jun. 13, 2017 Office Action issued in Indian Patent Application No. 4104/KOLNP/2009.

* cited by examiner

CRUMPLE-RESISTANT SECURITY SHEET, A METHOD OF MANUFACTURING SUCH A SHEET, AND A SECURITY DOCUMENT INCLUDING SUCH A SHEET

The invention relates to a security sheet that is resistant to crumpling, to a method of manufacturing such a sheet, and to a security document including such a sheet.

Currently, numerous security documents, such as banknotes or identity documents, comprise paper media. A drawback of the paper media that are used is that they offer poor resistance to crumpling. Thus, the crumpled zones present deep and irreversible creases or folds that offer poor resistance to soiling, so that the crumpled zones are weakened and often give rise to tears. That is a particularly major drawback for documents which, on being handled, are frequently creased, folded, or crumpled, such as, for example, banknotes, with the presence of creases or folds weakening them and shortening their lifetimes, and making it difficult for them to be handled in automated manner, e.g. when checking authenticity or wear on sorting machines.

An object of the invention is thus to provide a security sheet that offers good resistance to crumpling.

The Applicant has found that this object is achieved by providing a crumple-resistant security sheet comprising: fibers; an anionic polymer in a proportion lying in the range 5% to 45% by dry weight relative to the total dry weight of the fibers, and presenting a glass transition temperature greater than −40° C.; and a main cationic flocculation agent in a quantity lying in the range 1% to 5% by dry weight relative to the total dry weight of the fibers.

In the present application, the expression "total weight of the fibers" should be understood as meaning "total dry weight of the fibers", unless otherwise indicated.

The term "anionic polymer" is used herein to mean a polymer having anionic groups. This polymer has been used in the form of a stabilized dispersion or emulsion in an aqueous medium, such a dispersion or emulsion also being known as a "latex". Polymers in aqueous dispersion are in common use and are known to the person skilled in the art of the paper-making industry.

In order to assess the resistance to crumpling of the security sheet, Bendtsen porosity measurements were taken before and after crumpling. Due to the creases or folds formed, the crumpling operation degrades the surface of the paper in more or less pronounced manner, giving rise to an increase in its porosity and thus in its weakness. By comparing the values for the porosity of the paper before and after crumpling, it is thus possible to assess the resistance to crumpling of said paper. The less the increase in the porosity between the initial sheet and the crumpled sheet is marked, the more the paper is resistant to crumpling. The object is thus to obtain post-crumpling porosity values that are as low as possible.

In an embodiment of the invention, said sheet further comprises a secondary cationic flocculation agent in a quantity lying in the range 0.001% to 0.006% by dry weight relative to the total weight of the fibers. This embodiment is particularly advantageous when the proportion of the anionic polymer is high, in particular when it exceeds 20% by dry weight relative to the total weight of the fibers, because the presence of the secondary cationic flocculation agent makes it possible to improve the flocculation of the anionic polymer.

The Applicant has found that the presence of an anionic polymer and of flocculation agent(s) in the composition of the sheet of the invention makes it possible to improve significantly the crumple resistance of said sheet. Thus, the sheet of the invention can present a post-crumpling porosity close to the porosity of a non-crumpled sheet, i.e. the creases or folds caused by the crumpling hardly weaken the paper at all. This characteristic enables the security sheet of the invention to have a very long circulation lifetime.

The sheet of the invention also presents very high "double-folding" endurance.

In addition, the sheet of the invention presents tear strength equivalent to or greater than the tear strength of a sheet not including anionic polymer.

During the experiments that it has conducted, the Applicant has found that only those sheets including anionic polymers having glass transition temperatures greater than −40° C. had excellent crumple-resistance characteristics. The Applicant found that anionic polymers having glass transition temperatures lower than −40° C. were too "soft" for use in a security sheet, and led to sheets having mechanical properties, such as traction strength, tear strength, or dry or wet bursting strength that were degraded.

In a particular embodiment of the invention, said anionic polymer presents a glass transition temperature lying in the range −30° C. to 10° C.

The term "glass transition temperature" is used to mean the temperature below which the polymer is rigid. When the temperature increases, the polymer goes through a transition state that enables the macromolecular chains to slide relative to one another, and the polymer softens.

In a preferred embodiment of the invention, the proportion of said anionic polymer lies in the range 10% to 30% by dry weight relative to the total weight of the fibers.

In an embodiment of the invention, the fibers included in the composition of the sheet comprise cellulose fibers, in particular cotton fibers.

In particular, said cellulose fibers are present in a proportion greater than 60% by dry weight relative to the total dry weight of the composition of said sheet.

In a particular embodiment of the invention, said cellulose fibers represent at least 70% by dry weight of the total quantity of fibers.

In particular, said cellulose fibers are cotton fibers and they represent at least 70% by dry weight of the total quantity of fibers.

Preferably, in another embodiment of the invention, the fibers included in the composition of the sheet may comprise synthetic fibers. This embodiment is particularly advantageous because it makes it possible to improve further the tear strength properties of the sheet of the invention. During its research, the Applicant has found that, surprisingly, the use of synthetic fibers that are generally used to reinforce paper, had a synergistic effect with the use of the anionic polymer. By measurement, the Applicant has found that the sheets containing synthetic fibers, while continuing to have high crumple resistance, also have particularly high tear strength. The tear strength of the sheets in this particular embodiment of the invention was found to be higher than the tear strength of the sheets of the invention that do not include synthetic fibers, and higher than the tear strength of sheets that include synthetic fibers but not anionic polymer.

In a preferred embodiment of the invention, the synthetic fibers are in a quantity lying in the range 5% to 30% by dry weight relative to the total weight of the fibers.

In a particular embodiment of the invention, the sheet includes cotton fibers in a proportion of at least 70% by dry weight relative to the total weight of the fibers, and synthetic fibers in a proportion lying in the range 10% to 30% by dry weight relative to the total weight of the fibers, the sum total of the cotton fibers and of the synthetic fibers being equal to 100%.

In particular, the security sheets of the invention that include synthetic fibers present tear strength greater than 1300 mN.

In a preferred embodiment of the invention, said synthetic fibers are chosen from among polyamide fibers and/or polyester fibers. For example, they can be polyamide 6-6 fibers or polyester fibers sold by Kuraray under the trade name EP133.

In an embodiment of the invention, the anionic polymer present in the security sheet comprises a polymer presenting carboxyl functions. In particular, said polymer is a carboxylated styrene butadiene copolymer. Such copolymers are available, for example, from Dow Chemical Company with various glass transition temperatures.

In an embodiment of the invention, the main cationic flocculation agent is a cationic resin. In particular, said cationic resin is a polyamide-amine-epichlorohydrin (PARE) resin.

In another embodiment of the invention, the main cationic flocculation agent is chosen from polyacrylamides, polyethyleneimines, polyvinylamines, and mixtures thereof.

In an embodiment of the invention, the secondary cationic flocculation agent is chosen from polyacrylamides, polyethyleneimines, polyvinylamines, and mixtures thereof.

In an embodiment of the invention, the security sheet includes at least one security element.

In particular, said security element is chosen from optically variable devices (OVDs), in particular elements presenting interference effects and particularly iridescent elements, holograms, security threads, watermarks, planchet spots, pigments or fibers that are luminescent and/or iridescent and/or magnetic and/or metallic, and combinations thereof.

In addition, the sheet of the invention may include a radiofrequency identification (RFID) device.

In another embodiment of the invention, the security sheet of the invention includes at least one zone that is at least partially free of fibers, which zone is referred to as a "window".

In another embodiment, the security sheet of the invention includes a security thread or strip incorporated into said sheet and appearing in at least one window.

In an embodiment of the invention, the security sheet includes mineral fillers in a quantity lying in the range 1% to 10% by dry weight relative to the total weight of the fibers. In particular, said mineral fillers are present in a proportion lying in the range 1% to 5% by dry weight relative to the total weight of the fibers. Such fillers are chosen, for example, from calcium carbonate, kaolin, titanium dioxide, and mixtures thereof.

In another embodiment of the invention, the security sheet may further comprise an outer coating layer. Such coating layers, coating at least one face of a sheet, are well known to the person skilled in the art, and make it possible, for example when the layer is based on a polyvinyl alcohol, to improve the double-folding endurance and the traction strength of the sheet. In another example, the security sheet of the invention may further comprise a coating layer designed to reinforce its durability properties, such as, for example, a layer whose composition is described in Patent Application EP 1 319 104 and that comprises a transparent or translucent elastomer binder, such as polyurethane, and a colloidal silica.

The invention also provides a method of manufacturing the above-described security sheet.

According to the invention, the manufacturing method comprises the steps consisting in forming said sheet by a wet-process technique from an aqueous suspension containing:

fibers;

a stabilized aqueous dispersion (latex) of an anionic polymer in a proportion lying in the range 5% to 45% by dry weight relative to the total weight of the fibers, and presenting a glass transition temperature greater than −40° C.; and a main cationic flocculation agent in a quantity lying in the range 1% to 5% by dry weight relative to the total weight of the fibers;

and then in drying said sheet.

In an implementation of the invention, said aqueous suspension further contains a secondary cationic flocculation agent in a quantity lying in the range 0.001% to 0.006% by dry weight relative to the total weight of the fibers.

By using an anionic polymer and flocculation agents, the method of the invention makes it possible to cause said anionic polymer to precipitate onto the fibers and to obtain a security sheet that presents crumple-resistance properties that are particularly high.

In a particular implementation of the invention, said aqueous suspension is obtained from a mixture of fibers and of said main cationic flocculation agent, to which mixture said anionic polymer and said secondary cationic flocculation agent are added before proceeding to form said sheet. This implementation offers the advantage of being applicable to "standard" fiber aqueous suspensions used for manufacturing security sheets because they include wet strength agents that can also be used as main flocculation agents in the context of the present invention.

In a particular implementation of the method, said anionic polymer is added before said secondary flocculation agent.

In an implementation of the invention, said anionic polymer presents a glass transition temperature lying in the range −30° C. to 10° C.

In an implementation of the invention, the method of manufacturing the security sheet further comprises a step in which, after said suspension has been drained off, at least one face of said sheet is coated with a coating layer. Said coating layer can make it possible, for example, to improve the folding endurance and/or traction strength properties, or indeed the durability properties of said sheet, as described above.

The invention also provides a security document including the security sheet as described above or as obtained by the above-described method.

In particular, the invention provides a banknote.

The invention is described in more detail below by means of the following non-limiting examples and comparative examples.

The Applicant performed three series of tests: Series 1 and 2 were conducted on non-coated sheets, and Series 3 were conducted on sheets each coated with a coating layer, as generally applies to sheets included in security documents such as banknotes.

Measurements of pre-crumpling porosity and of post-crumpling porosity, of folding endurance (i.e. resistance to double-folding), and of tear strength were taken on the resulting sheets.

Series 1

COMPARATIVE EXAMPLE 1

A security sheet was made whose composition corresponded to the basic composition of a large number of banknotes currently in circulation.

For this purpose, said sheet was formed by a wet-process technique on a cylinder-mold paper-making machine, from an aqueous suspension containing only cotton fibers and a wet strength agent (a PAAE resin in this example) in a proportion of 2.1% by dry weight relative to the weight of the fibers.

The resulting sheet presented a weight expressed in grams per square meter of 85.2 g/m$^2$, and thickness of 142 micrometers (μm).

EXAMPLE 2

On a cylinder-mold paper-making machine, a sheet of the invention was made that comprised only cotton fibers, a carboxylated styrene butadiene copolymer having a glass transition temperature of −25° C. in a proportion of 11% by dry weight relative to the weight of the fibers, and a main flocculation agent in the form of a PAAE resin in a proportion of 2.3% by dry weight relative to the total weight of the fibers. The PAAE resin also acted as a wet strength agent, as in Comparative Example 1.

The resulting sheet presented a weight of 87.6 g/m$^2$, and a thickness of 124 μm.

EXAMPLE 3

A sheet of paper of the invention was made by using the composition of Example 2 and by adding thereto a polyacrylamide as a secondary flocculation agent in a proportion of 0.001% relative to the total weight of the fibers.

The resulting sheet presented a weight of 86.9 g/m$^2$ and a thickness of 125 μm.

EXAMPLE 4

A sheet of paper of the invention was made that comprised the same ingredients as in Example 3, the anionic polymer being present in a proportion of 25% by dry weight relative to the weight of the fibers, the main flocculation agent being present in a proportion of 2.6% by dry weight relative to the total weight of the fibers, and the secondary cationic flocculation agent being present in a proportion of 0.004% by dry weight relative to the total weight of the fibers.

The resulting sheet presented a weight of 86.5 g/m$^2$ and a thickness of 121 μm.

Series 2

COMPARATIVE EXAMPLE 5

A security sheet was made whose composition corresponded to the basic composition of a large number of banknotes currently in circulation.

For this purpose, said sheet was formed by a wet-process technique on a laboratory handsheet former, from an aqueous suspension containing only cotton fibers and a wet strength agent (a PAAE resin in this example) in a proportion of 2.5% by dry weight relative to the total weight of the fibers.

The resulting sheet presented a weight of 80.5 g/m$^2$, and thickness of 137 μm.

EXAMPLE 6

On a laboratory handsheet former, a sheet of paper of the invention was made that comprised only cotton fibers, a carboxylated styrene butadiene copolymer having a glass transition temperature of 5° C. in a proportion of 25% by dry weight relative to the total weight of the fibers, a PAAE resin as a main flocculation agent (also acting as a wet strength agent) in a proportion of 3.1% by dry weight relative to the total weight of the fibers, and a polyacrylamide as a secondary flocculation agent in a proportion of 0.003% by dry weight relative to the total weight of the fibers.

The resulting sheet presented a weight of 82.7 g/m$^2$, and a thickness of 132 μm.

EXAMPLE 7

On a laboratory handsheet former, a sheet of paper of the invention was made that comprised only cotton fibers, a carboxylated styrene butadiene copolymer having a glass transition temperature of 5° C. in a proportion of 11% by dry weight relative to the total weight of the fibers, a PAAE resin as a main flocculation agent (also acting as a wet strength agent) in a proportion of 2.8% by dry weight relative to the total weight of the fibers, and a polyacrylamide as a secondary flocculation agent in a proportion of 0.002% by dry weight relative to the total weight of the fibers.

The resulting sheet presented a weight of 83.4 g/m$^2$, and a thickness of 136 μm.

Series 3

COMPARATIVE EXAMPLE 8

A sheet was formed by a wet process technique on a cylinder-mold paper-making machine, from an aqueous suspension of only cotton fibers that also contained a wet strength agent (PAAE resin) in a proportion of 2.1% by dry weight relative to the total weight of the fibers. After being formed, the resulting sheet of paper was coated with a coating layer designed to improve the durability of the sheet, and comprising a polyurethane binder and a colloidal silica, as described in Application EP 1 319 104.

The resulting sheet presented a weight of 85.8 g/m$^2$, and a thickness of 97 μm.

COMPARATIVE EXAMPLE 9

A security sheet was made that comprised the same ingredients as in Comparative Example 8, but in which a fraction of the cotton fibers was replaced with polyamide fibers so that the proportion of cotton fibers was 85% by dry weight and the proportion of polyamide fibers was 15% by dry weight relative to the total dry weight of the fibers.

EXAMPLE 10

On a cylinder-mold paper-making machine, a sheet of paper of the invention was made that comprised only cotton fibers, a carboxylated styrene butadiene copolymer having a glass transition temperature of −26° C. in a proportion of 11% by dry weight relative to the total dry weight of the fibers, and a PAAE resin as a main flocculation agent (also acting as a wet strength agent) in a proportion of 2.3% by dry weight relative to the total dry weight of the fibers.

The resulting sheet presented a weight of 92.8 g/m$^2$, and a thickness of 103 μm.

EXAMPLE 11

On a cylinder-mold paper-making machine, a sheet of paper of the invention was made that comprised only cotton fibers, a carboxylated styrene butadiene copolymer having a glass transition temperature of −26° C. in a quantity of 11% by dry weight relative to the total weight of the fibers, a PAAE resin as a main flocculation agent in a proportion of 2.1% by dry weight relative to the total weight of the fibers, and a polyacrylamide as a secondary flocculation agent in a proportion of 0.001% by dry weight relative to the total dry weight of the fibers.

The resulting sheet presented a weight of 86.9 g/m$^2$, and a thickness of 100 μm.

EXAMPLE 12

On a cylinder-mold paper-making machine, a sheet of paper of the invention was made that comprised only cotton fibers, a carboxylated styrene butadiene copolymer having a glass transition temperature of −26° C. in a quantity of 25% by dry weight relative to the total dry weight of the fibers, a PAAE resin as a main flocculation agent (also acting as a wet strength agent) in a quantity of 2.6% by dry weight relative to the total dry weight of the fibers, and a polyacrylamide as a secondary flocculation agent in a proportion of 0.004% by dry weight relative to the total dry weight of the fibers.

The resulting sheet presented a weight of 82.9 g/m$^2$, and a thickness of 95 μm.

EXAMPLE 13

On a cylinder-mold paper-making machine, a sheet of paper of the invention was made by using the composition of Example 12, but by replacing a fraction of the cotton fibers with polyamide fibers so that the proportion of polyamide fibers was 15% by weight relative to the total dry weight of the fibers.

The resulting sheet presented a weight of 85.4 g/m$^2$, and a thickness of 108 μm.

Tests and Results

The measurements of porosity before and after crumpling (sheet crumpled eight times for each test) were taken in compliance with French Standard NF Q03-076. The crumpling was performed by an "NBS Crumpling Device" of the IGT brand.

The folding endurance measurements were performed in compliance with International Standard ISO 5626.

The tear strength measures were performed in compliance with European Standard EN 21974.

In order to evaluate wet resistance, bursting strength was measured in compliance with French Standard NF Q03-053, on wet and dry sheets. The wet strength value was then obtained using the following formula:

$$\text{Wet Strength} = \frac{\text{Wet Bursting Strength}}{\text{Dry Bursting Strength}} \times 100$$

TABLE 1

| Test | Comparative Example | Example 2 | Example 3 | Example 4 |
|---|---|---|---|---|
| Pre-crumpling porosity (cm$^3$/min) | 22 | 26 | 24 | 27 |
| Post-crumpling porosity (cm$^3$/min) | 206 | 147 | 145 | 89 |
| Improvement % | reference | −28.7% | −29.7% | −56.84% |
| Wet strength (%) | 48.6 | 50.3 | 52 | 52.5 |
| Double-folding endurance (number of folds) | 2620 | 3061 | 3304 | 4012 |
| Improvement % | reference | +16.8% | +26.1% | +53.1% |

TABLE 2

| Test | Comparative Example 5 | Example 6 | Example 7 |
|---|---|---|---|
| Pre-crumpling porosity (cm$^3$/min) | 131 | 101 | 117 |
| Post-crumpling porosity (cm$^3$/min) | 1043 | 545 | 855 |
| Improvement | reference | −47.8% | −18.1% |
| Double-folding endurance (number of folds) | 666 | 1479 | 1248 |
| Improvement | reference | +122.1% | +87.4% |

TABLE 3

| Test | Comparative Example 8 | Comparative Example 9 | Example 10 | Example 11 | Example 12 | Example 13 |
|---|---|---|---|---|---|---|
| Pre-crumpling porosity (cm$^3$/min) | 0 | 0 | 0 | 0 | 0 | 0 |
| Post-crumpling porosity (cm$^3$/min) | 103 | — | 41 | 24 | 15 | 12 |
| Improvement | reference | — | −61.2% | −77% | −85% | −88% |
| Wet strength (%) | 54.5 | — | 57.7 | 60.0 | 61.2 | 63.9 |
| Double-folding endurance (number of folds) | 3074 | 4655 | 4331 | 3908 | 5579 | 8807 |

TABLE 3-continued

| Test | Comparative Example 8 | Comparative Example 9 | Example 10 | Example 11 | Example 12 | Example 13 |
|---|---|---|---|---|---|---|
| Improvement % | reference | — | +41% | +27% | +81% | +186% |
| Tear strength (mN) | 760 | 870 | 820 | 760 | 660 | 1380 |
| Improvement % | −13% | reference | −6% | −13% | −24% | +59% |

Series 1

A shown in Table 1 which gives the results of Series 1, the security sheets of Examples 2 to 4 present post-crumpling porosities that are considerably improved relative to Comparative Example 1 which is taken as the reference (reduction in post-crumpling porosity by in the range 28% to 56%).

In the same way, for the sheets of the invention, the double-folding endurance is considerably increased relative to the sheet of Comparative Example 1 (increase lying in the range 16% to 53%).

Finally, it should be noted that the sheets of Examples 2 to 4 of the invention present wet strength values that are very close to and even slightly greater than the wet strength value of Comparative Example 1, thereby showing that the flocculation agent used (PAAE resin) continues to act as effectively as a wet strength agent.

Series 2

As shown in Table 2 which gives the results of Series 2, the sheets of Examples 6 and 7 of the invention present post-crumpling porosities that are considerably improved relative to Comparative Example 5 which is taken as the reference (reduction of in the range 17% to 48% of the post-crumpling porosity).

In the same manner, for the sheets of the invention, the double-folding endurance is considerably increased relative to the sheet of Comparative Example 5 which is taken as the reference (increase lying in the range 87% to 122%).

Series 3

As shown in Table 3 which is recapitulative of the results of Series 3, the security sheets of Comparative Examples 8 and 9 and of the various examples 10 to 13 present pre-crumpling porosities that are substantially zero, unlike the sheets of Series 1 and 2. This can be explained by the presence of a coating layer that "blocks off" the pores at the surface of the sheets.

After crumpling, all of the sheets of the examples present porosities less than the porosity of Comparative Example 8. The rate of improvement relative to Comparative Example 8 which is taken as the reference varies in the range 77% to 88%. The post-crumpling porosities of the sheets of the invention are very close to the pre-crumpling porosity of the comparative example 8.

As regards double-folding endurance, the sheets of the invention of Examples 10 to 13 present improvements lying in the range 27% to 186% relative to the sheet not including anionic polymer of Comparative Example 8 which is taken as the reference.

As regards tear strength, Examples 10 to 13 were compared with Comparative Example 9 in order to determine the synergy between the presence of synthetic fibers and the presence of an anionic polymer.

The sheet of Comparative Example 9 does not contain any anionic polymer but it does contain polyamide fibers in a proportion of 15%. The tear strength of the sheet of Comparative Example 8 is 13% less than the tear strength of the sheet of Comparative Example 2, which confirms the effect of the synthetic fibers.

Examples 10 to 12 present tear strength values that are less than or equal to those of Comparative Example 8, and less than those of Comparative Example 9, i.e. the presence of an anionic polymer alone has no beneficial influence on tear strength.

Example 13 presents a tear strength value greater than that of Comparative Example 8 but also significantly greater (+59%) than that of Comparative Example 9. Therefore, the combination of the presence of synthetic fibers and of the presence of an anionic polymer in the composition of the security sheet has a synergistic effect on the tear strength of said sheet.

Finally, it should be noted that the sheets of Examples 10 to 13 of the invention present wet strength values very close to and even slightly greater than the wet strength value of Comparative Example 8, which shows that the flocculation agent used (PAAE resin) continues to act as effectively as a wet strength agent.

The invention claimed is:

1. A method of manufacturing a crumple-resistant security sheet, the method comprising the steps of forming the sheet by a wet-process technique from an aqueous suspension containing:

fibers;

a stabilized aqueous dispersion of an anionic polymer in a proportion lying in a range of 5% to 45% by dry weight relative to a total dry weight of the fibers, and having a glass transition temperature greater than −40° C.; and a cationic flocculation agent in a quantity lying in a range of 1% to 5% by dry weight relative to the total dry weight of the fibers;

wherein the anionic polymer is configured to precipitate onto the fibers in the presence of the cationic flocculation agent;

then drying the sheet, and applying a coating layer to at least one face of the security sheet.

2. The manufacturing method according to claim 1, wherein the anionic polymer has a glass transition temperature lying in the range −30° C. to 10° C.

3. The manufacturing method according to claim 1, wherein the anionic polymer is structured not to be cross-linkable.

4. The manufacturing method according to claim 1, wherein the anionic polymer comprises a polymer having carboxyl functions.

5. The manufacturing method according to claim 1, wherein the anionic polymer comprises a carboxylated styrene butadiene copolymer.

6. The manufacturing method according to claim 1, wherein the cationic flocculation agent is a cationic resin.

7. The manufacturing method according to claim 6, wherein the cationic resin is a polyamide-amine-epichlorohydrin (PAAE) resin.

8. The manufacturing method according to claim 1, wherein the cationic flocculation agent is selected from the group consisting of polyacrylamides, polyethyleneimines, polyvinylamines, and mixtures thereof.

9. The manufacturing method according to claim 1, wherein the fibers comprise cellulose fibers.

10. The manufacturing method according to claim 9, wherein the cellulose fibers represent at least 70% by dry weight of a total quantity of the fibers.

11. The manufacturing method according to claim 1, wherein the fibers comprise synthetic fibers.

12. The manufacturing method according to claim 11, wherein the synthetic fibers are selected from the group consisting of polyamide fibers, polyester fibers, and mixtures thereof.

13. The manufacturing method according to claim 1, wherein the sheet further comprises a secondary cationic flocculation agent in a quantity in the range 0.001% to 0.006% by dry weight relative to the total dry weight of the fibers.

14. The manufacturing method according to claim 13, wherein the secondary cationic flocculation agent is selected from the group consisting of polyacrylamides, polyethyleneimines, polyvinylamines, and mixtures thereof.

15. The manufacturing method according to claim 1, wherein the sheet includes at least one security element.

16. The manufacturing method according to claim 1, wherein the security sheet has a thickness of in a range of 95-142 μm.

17. The manufacturing method according to claim 1, wherein the sheet has tear strength greater than 1300 mN.

18. The manufacturing method according to claim 1, wherein the sheet has a double-folding endurance in the range of 3908 folds to 8807 folds.

19. The manufacturing method according to claim 1, wherein the sheet has a wet strength in the range of 57.7% to 63.9%.

20. A security document including a security sheet obtained by the manufacturing method according to claim 1.

21. The security document according to claim 20, wherein the document is a banknote.

* * * * *